United States Patent [19]

Tanaka

[11] 3,942,886

[45] Mar. 9, 1976

[54] DISPLAY UNIT EQUIPPED WITH COPYING DEVICE

[75] Inventor: Atsuyuki Tanaka, Sakai, Japan

[73] Assignee: Minolta Camera Kabushiki Kaisha, Azuchi, Japan

[22] Filed: July 22, 1974

[21] Appl. No.: 490,708

[30] Foreign Application Priority Data

Aug. 6, 1973 Japan ..... 48-88171

[52] U.S. Cl. ..... 355/1; 354/5; 355/3 R; 355/5; 355/8

[51] Int. Cl.[2] ..... G03G 15/22

[58] Field of Search ..... 355/1, 11, 44, 67, 71, 355/8, 5, 3 SH; 96/45.1; 354/5, 6, 12, 17; 340/166 EL, 173 PL; 346/74 P; 350/96 B

[56] References Cited

UNITED STATES PATENTS

| | | | |
|---|---|---|---|
| 3,267,555 | 8/1966 | Berger et al. | 355/11 X |
| 3,658,407 | 4/1972 | Kitano et al. | 355/1 X |
| 3,677,633 | 7/1972 | Huber | 355/8 X |
| 3,810,198 | 5/1974 | Camp et al. | 354/12 |
| 3,824,604 | 7/1974 | Stein | 354/5 |

*Primary Examiner*—L. T. Hix
*Assistant Examiner*—Kenneth C. Hutchison
*Attorney, Agent, or Firm*—Wenderoth, Lind & Ponack

[57] ABSTRACT

A display unit equipped with a copying device. The display unit has a double-sided display panel secured at the front of unit housing, a light shield film movably provided behind the display panel in parallel and spaced relation to the latter, a guide plate for a photosensitive copy paper sheet fixedly provided behind the shield film, and associated devices for developing the copy paper sheet. The shield film has a compact exposure member of image transmitters formed of a plurality of graded index fibers in bundled configuration which can advantageously direct, when desired, the image rays at the back surface of the display panel onto the copy paper sheet while the same images are being observed with the naked eye at the front of the panel.

7 Claims, 3 Drawing Figures

DISPLAY UNIT EQUIPPED WITH COPYING DEVICE

Figure 1:
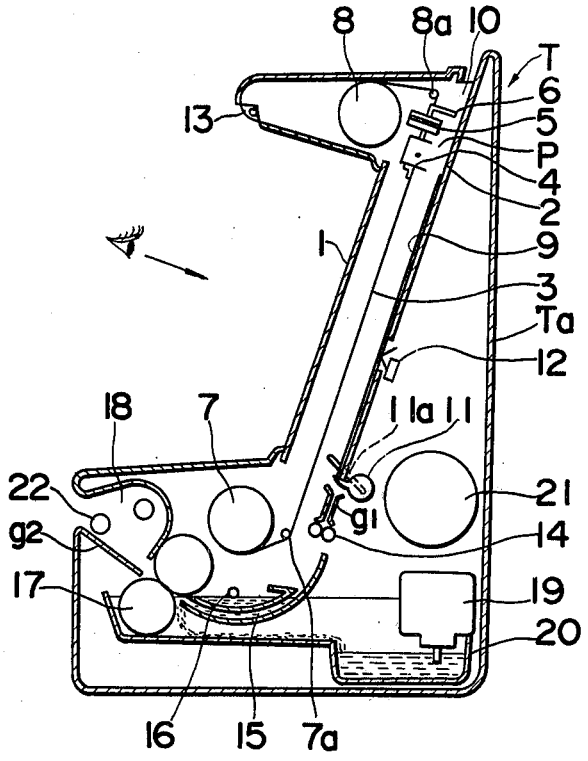

The present invention relates to a display unit and, more particularly, to a display unit of the double-sided indication panel type equipped with a copying device.

In recent years, in the display units of the cathode ray tube type (CRT), etc., there have been proposed display units capable of copying the images being observed in cases where thhe duplicates of such images are required.

Conventionally, in one of such systems of the above described type, a half mirror is provided in front of the display panel, through which half mirror the images on the display panel are observed with the naked eye, while the images being observed are copied simultaneously, when desired, by the reflected light therefrom through the half mirror. In the other systems, the images on the display panel being observed are reflected through a plurality of reflecting mirrors provided instead of the above half mirror, so that the image rays reflected by the reflecting mirrors pass through a lens provided with the optical axis thereof deviated for simultaneous copying of the images being observed.

However, such conventional units have many disadvantages. For example, in the former, the employment of the half mirror leads to an insufficient amount of light, resulting in poor definition both in the images being observed and in the copied images, while in the latter, it is inevitable that the copied images are not sufficiently clear since the lens employed is in the deviated optical axis.

Furthermore, in both of the above conventional systems, the unit itself tends to be large and heavy in weight, since spherical lenses are employed in syuch systems.

Accordingly, an essential object of the present invention is to provide a display unit of the double-sided display panel type equipped with a copying device which will produce a clear and definite copy of the images being observed with substantial elimination of the disadvantages inherent in the conventional display units having copying devices.

Another important object of the present invention is to provide a display unit equipped with a copying device of the above described type which is accurate in function, simple in construction and easy to maintain.

A still further object of the present invention is to provide a display unit equipped with a copying device of the above described type which is compact in size and light in weight.

According to a preferred embodiment of the present invention, the display unit equipped with the copying device comprises a recently developed double-sided display panel such as a plasma display panel or a liquid crystal display panel such as disclosed in Electronics, Apr. 12, 1973, p. 95 fixedly mounted at the front of the display unit housing, a light shield film movably supported, behind the display panel, at a position in parallel to and at a fixed distance from the panel, by upper and lower rollers for selectively winding the light shield film upward or downward, an exposure member together with a corona charger and a stop releasing lever which is interposed in a cut portion formed in the shield film and integrally connected with the shield film for simultaneous movment with the latter, a guide plate for a copy paper sheet fixedly mounted on the unit housing at a position behind the shield film in spaced and parallel relation to the shield film, and associated developing and drying devices for the copy paper sheet, so that the light rays from the images at the back surface of the double-sided panel can be advantageously directed onto the photosensitive copy paper sheet placed on the guide panel through the exposure member while the same images are being observed at the front of the panel.

The known plasma display panel (PDP) employed in the above display unit of the invention is composed of two glass bases on each of which a plurality of metal electrodes in the form of thin wires are fixedly mounted in parallel and spaced relation to each other. The two glass bases thus formed are combined with a thin glass insulating layer sandwiched between the surfaces of the glass bases having the metal electrodes, leaving a narrow space for electrical discharge between one surface of the glass insulating layer and the electrode disposed surface of one of the glass bases, so that in the combined state, the wire shaped metal electrodes disposed on the two glass bases cross at right angles to each other to form a wire mesh-like configuration with the insulating layer and the discharging space therebetween. In order to facilitate the electrical discharge between the electrodes, a gas mainly comprising neon gas is filled in the discharging space with the edges of the two glass bases suitably sealed to make the panel airtight. In such a plasma display panel, individual crossing electrodes function as luminant points which can be independently turned on or off so as to form images on the panel by the application of a predetermined voltage and turning-on pulses whenever necessary. Such an image display panel is disclosed, for example by Krupka et al., Proceedings of the IEEE Vol. 61, No. 7, July 1973, pp. 1025–1029.

On the other hand, the exposure member as employed in the above embodiment is composed of a plurality of image transmitters formed a bundle of optical fibers of graded refractive index such as a "SELFOC" lens (a trademark registered in Japan and owned by Nippon Sheet Glass Co., Ltd.) which have excellent image transmitting functions despite their extremely shorrt focal distance as compared with that of conventional optical systems.

The term SELFOC lens refers to an image transmitting optical fiber having a refractive index distribution in a cross section thereof that varies consecutively and parabolically outwards from a center portion, said refractive index distribution satisfying the following equation: $n = N(1-ar^2)$, wherein $N$ is the refractive index at the center, $n$ is the refractive index at a distance $r$ from the center and $a$ is a positive constant. The SELFOC lens and the image transmitter formed by a bundle of such optical fibers are described in U.S. Pat. No. 3,658,407, patented on Apr. 25, 1972, and therefore reference may be made thereto for the details thereof.

As is seen from the above description, since the images on the back surface of the two-sided display panel which have not hitherto been used are positively utilized together with the image transmitter such as the SELFOC lens having short conjugate distance which is bright with a small F value, clear and definite images can be obtained simultaneously on the panel being observed and the copy paper sheets and the size and weight of the display can be reduced to a large extent.

Figure 2:
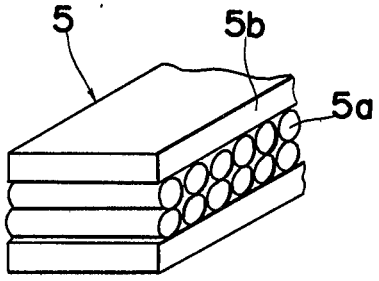
Figure 3:
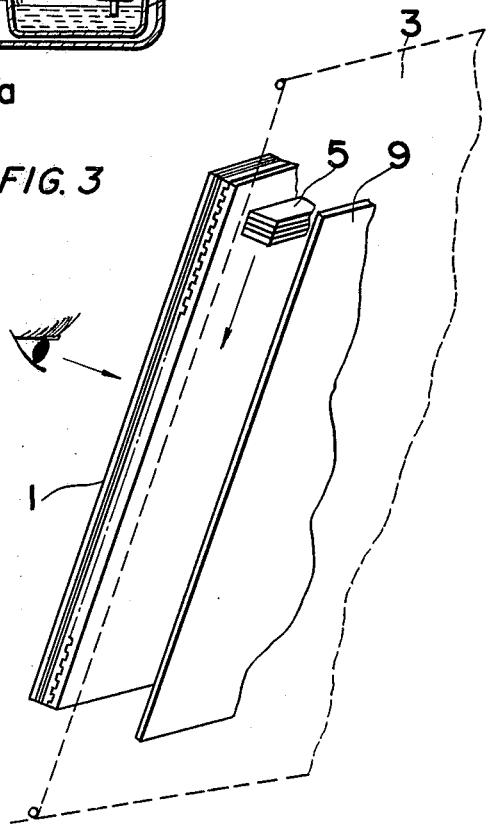

These and other objects and features of the present invention will become apparent from the following description taken in conjunction with the preferred embodiments thereof with reference to the accompanying drawings, in which;

FIG. 1 is a schematic sectional side view of a display unit equipped with a copying device embodying the present invention, FIG. 2 is a perspective view, on an enlarged scale, of a section of an exposure member employed in the display unit in FIG. 1, and FIG. 3 is a perspective view, partly in section, showing the relation of the display panel, an exposure member and a guide plate for a copy paper sheet.

Before the description of the present invention proceeds, it is to be noted that like parts are designated by like numerals throughout the several views of the accompanying drawings.

Referring to FIGS. 1 to 3, there is shown a display unit T of the present invention which comprises a known plasma double-sided display panel 1 as described above fixedly mounted at the front of the unit housing T*a*, a light shield film 3 which is movably supported, at opposite upper and lower edges thereof, in a position behind the panel 1 parallel to and at a fixed distance from the latter, by an upper roller 8 and a lower roller 7 and guide pins 8*a* and 7*a*, and a guide plate 2 is fixedly mounted on the housing T*a* behind the film 3 and in parallel spaced relation thereto and; passage P for a photosensitive copy paper sheet 9 between the light shield film 3 and guide plate 2.

The light shield film 3 which is for preventing the copy paper sheet 9 from being exposed to light rays from the panel 1 except during copying is further provided, at an intermediate position thereof, with a cut portion in which a corona charger 4, an exposure member 5 *a*, as described and a stop releasing lever 6 are interposed in parallel to each other and integrally connected to the film 3, so that when the shield film 3 is selectively wound onto the upper roller 8 or the lower roller 7, the exposure member 5 moves upward or downward together with the corona charger 4 and the stop releasing lever 6.

It should be noted here that, when the images being displayed on the panel 1 are not to be copied, the exposure member 5 together with the corona charger 4 and the lever 6 is kept stationary at the upper starting position adjacent to the upper roller 8 as shown in FIG. 1.

Referring particularly to FIG. 2, the exposure member 5 is composed of many image transmitters 5*a* formed of a plurality of graded index fibers is bundled configuration which are disposed in parallel to one another, and combined into one exposure unit 5 by an adhesive 5*b*.

The pitch of the optical light path of the above image transmitter 5*a* is in the third and fourth quadrants, and the image formed thereby is adapted to be an erect real image as described, for example, in the U.S. Pat. No. 3,658,407.

The photosensitive copy paper sheet 9 prepared from, for example, zinc oxide paper is inserted into the unit housing T*a* through an inlet 10 provided at the upper portion of the housing T*a* through the passage P with the leading edge of the sheet 9 supported by a projecting end of a stop 11 which is pivotally mounted at the lower portion of the passage P, thus the sheet 9 being kept in a stationary position behind the light shield film 3. A detection switch 12 for detecting the presence of the copy paper sheet 9 is provided at the middle portion of the passage P with the movable contact arm of the switch 12 projecting above the surface of the guide plate 2 to a certain extent. While the copy paper sheet 9 is present on the guide plate 2, the arm of the switch 12 is depressed by the sheet 9 to actuate the switch 12, which in turn actuates an indicator 13 provided in front of the unit T above the display panel 1 to show the presence of the copy paper sheet 9. The stop 11 is in integral engagement with a contact member 11*a* to contact with the stop releasing lever 6 provided on the film 3, which stop 11 and the member 11*a* are normally urged clockwise by a biasing means (not shown) with the end of the stop 11 projecting into the passage P to such an extent as to be sufficient to support the leading end of the copy paper sheet 9.

Guide plates *g*1 and a pair of rollers 14 are provided below the stopper 11 for transporting the sheet 9 into a developing device 15 after exposure. An opening 16 for pouring developing solution over the sheet 9 is formed above the developing device 15 for developing the copy paper sheet 9 after completion of the exposure. For this purpose, the developing solution collected in the reservoir 20 is adapted to be pumped up by a supply pump (not shown) and supplied to the developing device 15 through the opening 16. Excessive developing solution is removed from the copy paper sheet 9 after development by a pair of squeezing rollers 17, after which the sheet 9 is dried by a drier 18 and then discharged from the housing T*a* by a roller 22 and a guide plate *g*2. For continuously replenishing the reservoir 20 with the developing solution, a tank 19 for developing solution is releasably provided at the lower right portion of the housing T*a* in FIG. 1. Further, a driving motor 21 is provided above the tank 19 for selectively rotating the upper roller 8 or lower roller 7 through clutches and a delay circuit (not shown) so as to selectively wind the light shielding film 3 onto the roller 8 or roller 7, and consequently to move the image transmitter 5 together with the corona charger 4 and lever 6.

By this arrangement, the presence of the photosensitive copy paper sheet 9 is first confirmed by the indicator 13 prior to the operation of the plasma display unit T of the invention equipped with the copying device. If the unit T is not loaded with a copy paper sheet, the sheet 9 is inserted into the unit housing T*a* through the inlet 10, which sheet 9 is kept in position on the guide plate 2 in the housing T*a* by the stop 11.

When it becomes necessary to make a copy of the images being displayed on the display panel 1 during observation of the latter, a print button (not shown) is depressed for driving the motor 21. Upon rotation of the motor 21, the roller 7 is rotated to wind the light shield film 3 downward, and consequently the exposure member 5 together with the corona charger 4 and the stop releasing lever 6 which is integral with the film 3 move downward from the upper starting position as in FIG. 3, during which descent the photosensitive copy paper sheet 9 is first charged by the corona charger 4 and then exposed sequentially to the image rays corresponding to the images being displayed on the panel 1 by the exposure member 5 with electrostatic latent images thus being formed on the copy paper sheet 9. In the above process, no reflection by mirrors is necessary, since the mirror images at the reverse side of the display panel 1 can be utilized for the purpose.

Upon completion of the charging and exposure of the copy paper sheet 9 as described above, the stop releasing lever 6 which is provided subsequent to the exposure member 5 engages the contact member 11*a* which is integrally connected to the stop 11, turning the latter counterclockwise against the urging force thereof, the stop and contact member being retained at the turned positions by a retainer (not shown). Accordingly, the sheet 9 falls downward to be transported into the developing device 15 through the guide plates *g*1 and rollers 14, and is discharged from the housing T*a* through the squeezing rollers 17, the drier 18, and the roller 22 and guide plate *g*2 after having been developed at the developing device 15 by the developing solution poured onto the sheet 9 through the opening 16, and the copying is thus completed.

On the other hand, when the stop 11 is turned counterclockwise, i.e., when the exposure is completed, the rotation of the lower roller 7 is stopped by disengaging a clutch (not shown), and after the trailing edge of the sheet 9 has entered the developing device 15, the upper roller 8 is rotated, through a delay circuit (not shown), to wind the film 3 upward to bring the exposure member 5 together with the corona charger 4 and the lever 6 back into the original starting position in FIG. 1. The returning of the lever 6 is adapted to release the retainer (not shown) for the stop 11 with the stop 11 returned to the original position in FIG. 1 by the action of the biasing means (not shown).

As is clear from the above description, the display unit equipped with a copying device of the present invention employs the double-sided display panel such as the plasma display panel to positively utilize the images at the back surface of the double-sided panel with an image transmitter having a small F-value such as SELFOC lens provided to face the back surface of the display panel for directly projecting the images thereon onto a photosensitive copy paper sheet.

Since no half mirror or lens with a deviated optical axis as used in the conventional unit is employed in the display unit of the invention, extremely clear and definite images can be copied on the copy paper sheets and besides, definition of the images on the display panel is not affected at all by the optical system for the copying.

Furthermore, in the display unit of the present invention, the images at the back surface of the double-sided display panel, i.e., the mirror images are advantageously utilized for copying, so that it is unnecessary to convert the images into mirror images by separate reflecting mirrors or the like, resulting in a reduced number of parts, which fact, together with the adoption of an image transmitter formed of a plurality of graded index fibers is bundled configuration such as SELFOC lens for the image forming optical system, reduces the size of the unit to a large extent, making it possible to produce a unit of very compact size and light weight.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A display unit equipped with a copying device comprising: a double-sided display panel fixedly mounted at the front of the display unit; a light shield film movably supported behind said display panel in a position parallel with and at a fixed distance from said panel; winding members at the opposite ends of said display panel between which said light shield film extends and around which the ends of said light shield film are wound for selectively winding said light shield film along said display panel; a corona charger, an exposure member including a plurality of image transmitters constituted by a bundle of optical fiber lenses of graded refractive index, and a stop releasing member connected to each other for movement together and integrally connected in said light shield film for simultaneous movement with said light shield film with said corona charger being positioned ahead of said exposure member relative to the direction of movement thereof during the exposure of the copy paper to the image and said stop releasing member being located in a position for actuating the stop member at the termination of said exposure of the copy paper to said image; means for selectively driving said winding members; a guide member fixedly mounted on said unit at a position behind said light shield film in spaced and parallel relationship to said light shield film for guiding a photosensitive copy paper into said unit and supporting it therein; a stop member along said guide member for holding the copy paper in exposure position along said guide member, said stop member being movable for releasing said copy paper, and associated developing means for said copy paper adjacent said guide member for receiving the copy paper from said guide member after it has been released, whereby when a copy is to be made, copy paper is positioned on said guide member and said winding members are driven to move said corona charger, exposure member and stop releasing member parallel to said guide member between the guide member and the display panel for charging the copy paper, exposing it to the image from the rear of the display panel, and engaging the stop member for releasing the copy paper when it has been completely exposed.

2. A display unit as claimed in claim 1 in which said means for selectively driving said winding members comprises means for driving said winding members, after completion of exposure, in a direction for moving said light shield film in the opposite direction from its movement during exposure for returning said corona charger, exposure member and stop releasing member to their initial position, said stop member being actuated by said stop releasing member during the return movement thereof for return to its initial position for holding the copy paper.

3. A display unit as claimed in claim 1 further comprising means for detecting the presence of a sheet of copy paper in said unit, and an indicator lamp on the front of the unit coupled to said detecting means for providing an indication of when a sheet of copy paper is present in the unit.

4. A display unit as claimed in claim 1 in which said guide member is a guide plate inclined downwardly and forwardly in said unit, and said unit having an aperture therein above said guide plate for insertion of copy paper, the copy paper moving downwardly along said guide plate to said stop member due to its own weight.

5. A display unit as claimed in claim 4 in which said developing means is beneath the lower end of said guide plate and having means for guiding the copy paper therethrough for discharging the copy paper with the surface having the image thereon uppermost.

6. A display unit as claimed in claim 1 in which said display panel is a plasma display panel.

7. A display unit as claimed in claim 1 in which said display panel is a liquid crystal display panel.

* * * * *